United States Patent [19]

Loveland

[11] 4,006,579

[45] Feb. 8, 1977

[54] AUTOMATIC CARTON CLOSING MACHINE HAVING A THREE-POSITION CARTON STOP PADDLE INCLUDING A SLOPED INTERMEDIATE ONE AS AN UPFOLDED BOTTOM END FLAPS GUIDING RAMP

[75] Inventor: Winton Loveland, Fort Salonga, N.Y.

[73] Assignee: The Loveshaw Corporation, Deer Park, N.Y.

[22] Filed: Mar. 19, 1976

[21] Appl. No.: 668,416

[52] U.S. Cl. ..... 53/374
[51] Int. Cl.[2] ..... B65B 7/20
[58] Field of Search ..... 53/374, 375, 383

[56] References Cited

UNITED STATES PATENTS

| | | | |
|---|---|---|---|
| 2,095,258 | 10/1937 | Kimball et al. | 53/374 |
| 2,252,435 | 8/1941 | Lust | 53/374 |

*Primary Examiner*—Travis S. McGehee
*Attorney, Agent, or Firm*—Watson Leavenworth Kelton & Taggart

[57] ABSTRACT

Automatic carton closing machine equipped with a swingable stop paddle between a bottom prone position allowing carton advance thereover; an upright carton stopping position in the carton advancing path; and an intermediate oblique upwardly and forwardly sloping ramp position for guiding up and forward over an adhesive applicator head the upfolded bottom end flaps when dropping down because of carton contained load thereon. Specific operating mechanism which may be preferred can be pneumatically driven manipulator means so controlled and governed as to provide when desired relatively slow swinging rise from the prone position to the upright position as the clamping side guide rails separate to receive therebetween an oncoming loaded carton and then inward to opposite sides of the latter with strong clamping action as the upright stop paddle stops this carton. This preferred mechanism may then retract this stop paddle quickly to its prone position for further carton advance with conversion of the clamping force of the side rails to advance-permitting guidance. And finally in one cycle of operation on a single loaded carton as the latter advances through the machine it will desirably raise this stop paddle quickly to its intermediate sloping ramp position for performing its end flaps guiding service.

10 Claims, 7 Drawing Figures

11
12
10
14
314
214
114
23
24
16
32
31
19
21
22
25
30
20
15
43
119
117
118
17
18
47
49
54
129
42
62
229
28
64
29
27
26
13

69
70
71
66
68
67
72
AIR FLOW
47
54
64
43
SV3
29
229
SV17
129
59
55
42
45
46
56
52
65
28
25
148
57
61
51
48
49
40
44
58
60
53
41
50
63
62

FIG. 2
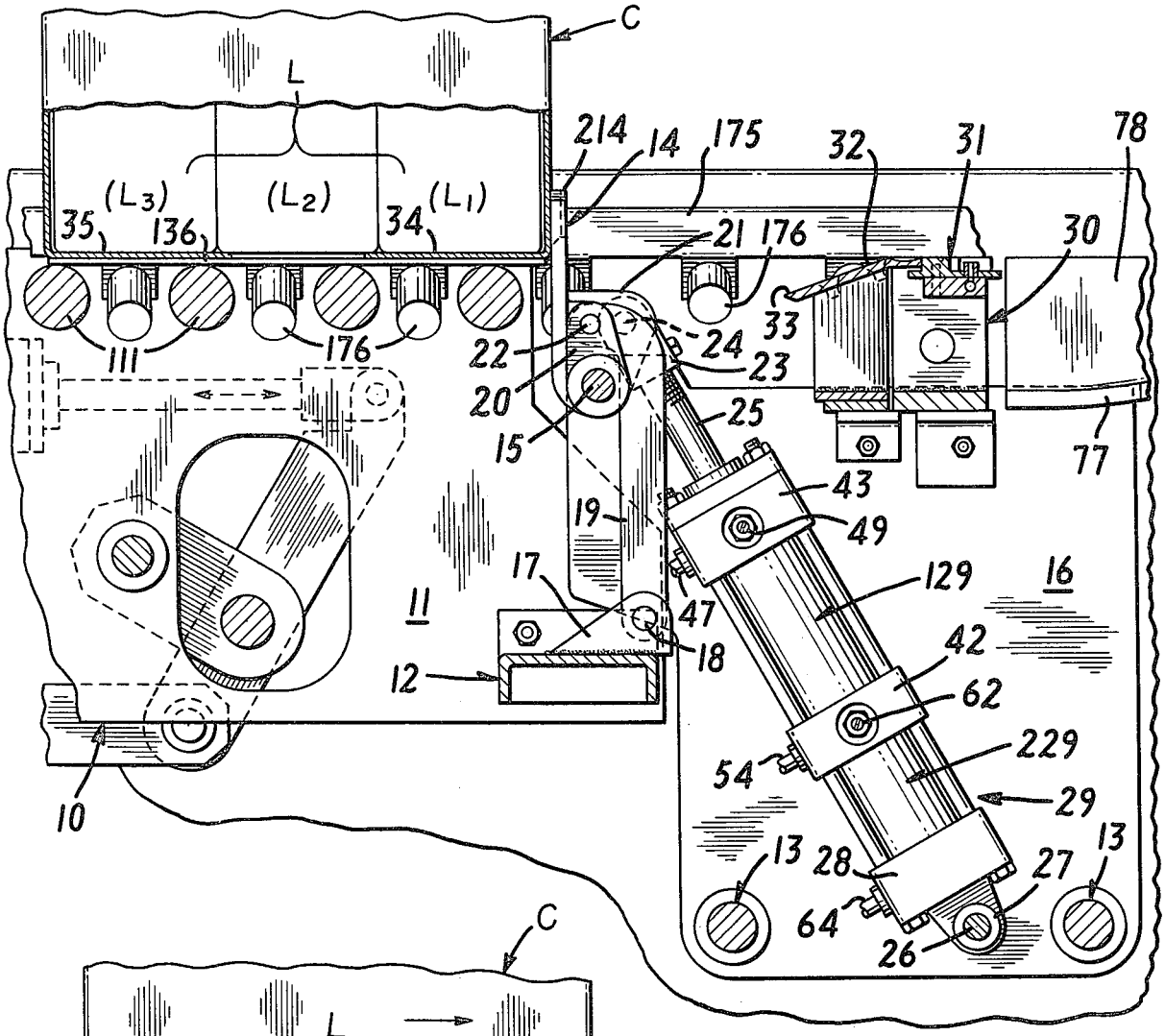
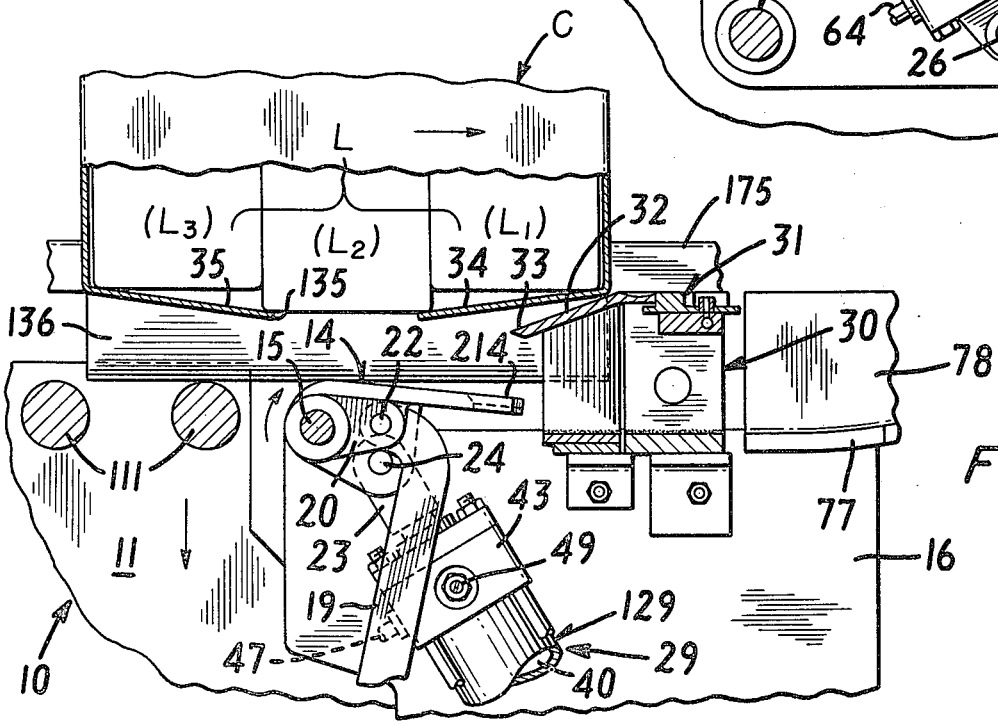
FIG. 3

FIG. 4
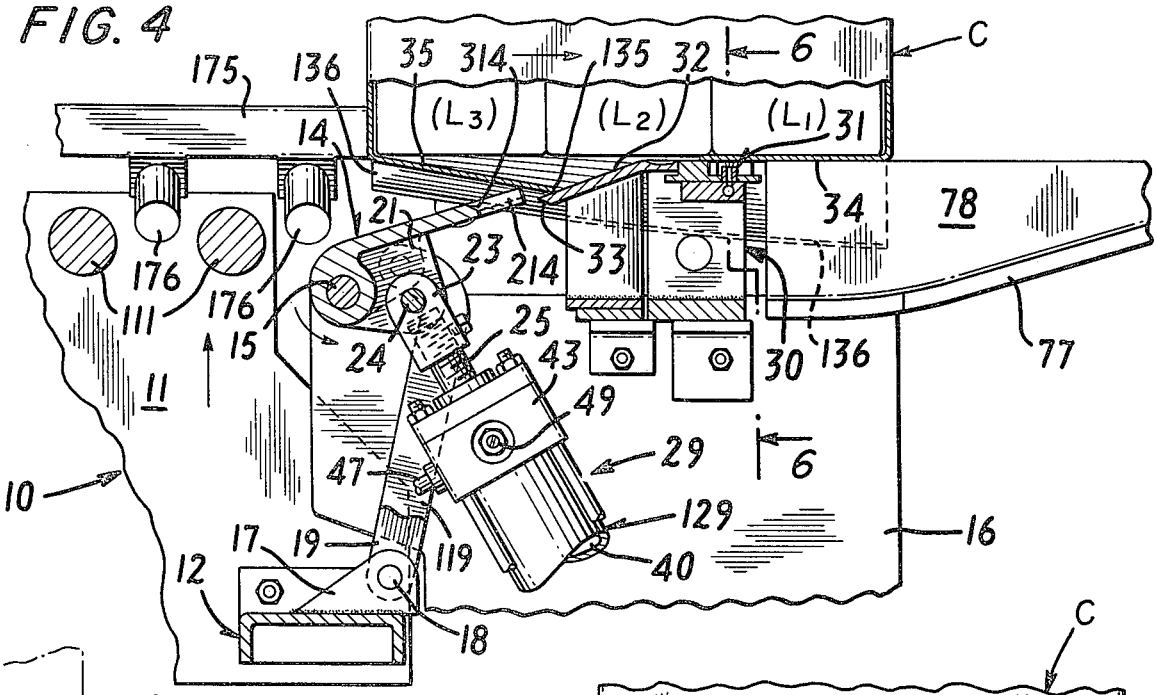
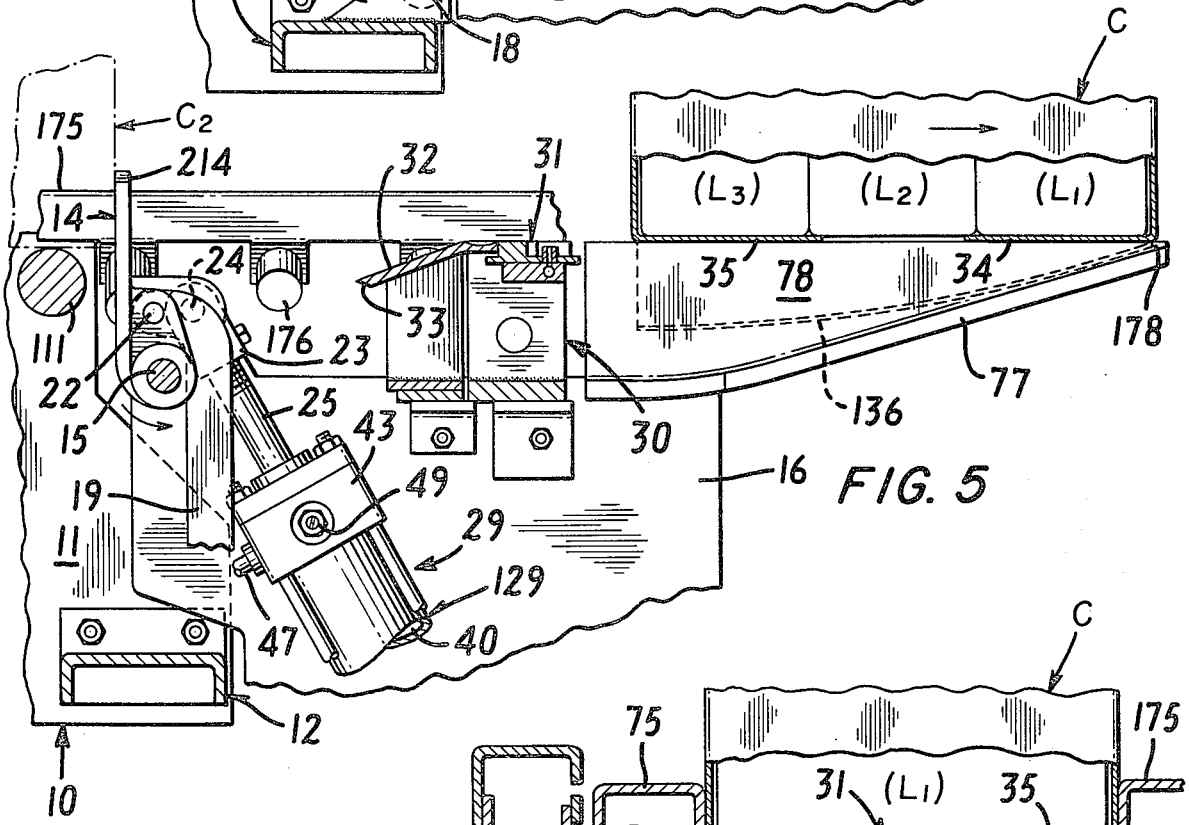
FIG. 5
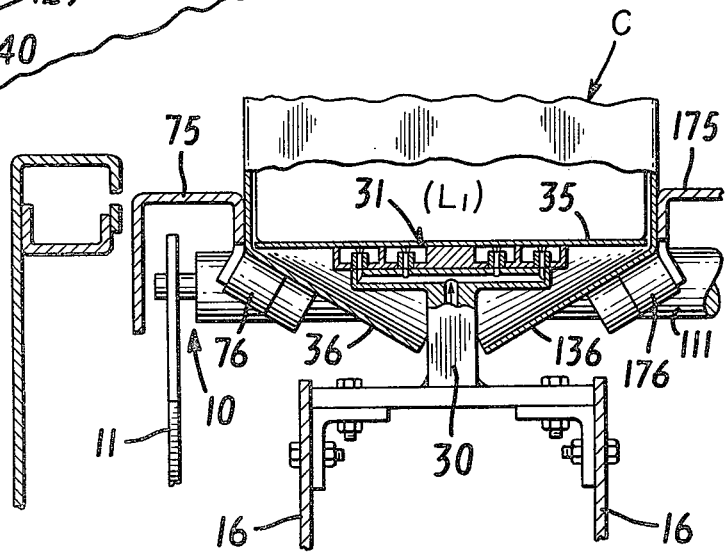
FIG. 6

AUTOMATIC CARTON CLOSING MACHINE HAVING A THREE-POSITION CARTON STOP PADDLE INCLUDING A SLOPED INTERMEDIATE ONE AS AN UPFOLDED BOTTOM END FLAPS GUIDING RAMP

BACKGROUND AND SUMMARY

The present invention is concerned with the efficient obtainment of additional useful service from carton checking stop paddle gate structures of automatic carton closing machines of the types shown in U.S. Pat. Nos. 3,382,645 of May 14, 1968 and 3,496,697 of Feb. 24, 1970. As background information in this automatic carton closing machine art, U.S. Pat. No. 3,382,645 teaches the use of an electrical control system of a plurality of solenoid valves which are cooperatively associated to dictate pneumatic operative raising and lowering of a carton stop paddle, and U.S. Pat No. 3,496,697 teaches the use thereof in a machine equipped with an Up/Down or lifting and lowering carriage which in its upper position serves as an initial conveyor section leading to the swung up stop paddle and ultimately, after the latter is swung down to free the carton for further advance, transfers the carton to oblique rollers on the opposed inner sides of the longitudinally-extending clamping rails converted at that time to guide rails. The present inventive improvement is concerned with the carton stop paddle, its mount, and the operative mechanism which manipulates it with additional and desired service thereof made possible by the latter.

The swinging operation of the stop paddle is designed to perform three functions. The first function (1) is to swing up, preferably slowly, and stand upright upon the raised lift and lowering carriage to provide a closed gate in the forward path of a loaded carton that has just entered the machine and is advancing on this carriage with its top open and with its bottom flaps folded upward into a temporary bottom closing stack. The second function (2) is to swing down, preferably fast, out of the way of this carton, i.e., release it, as an oncoming cross flight of the chain conveyor which was started up after the leading upstanding top end flap was folded back down by the lowered head so that the trailing top end flap can be folded forwardly down and the upstanding top side flaps can then be plowed down thereover as this carton is conveyed forward. This second function includes simultaneously transferring the closed carton, while being urged forward, from the lowering carriage to oblique support rollers on the side guide rails so that the upfolded bottom side flaps will droop obliquely down to allow the upfolded bottom end flaps to travel over an adhesive applying head for applying adhesive on them during further carton advance, with the help of a sloped manifold plate fixed to this adhesive head to guide the leading upfolded bottom end flap up thereover to above this head. The third function (3) is to raise this stop paddle, preferably quickly, back up to an intermediate and forwardly oblique position for causing its top surface to be directed slightly above the oblique top surface of the sloped manifold plate, so that the leading free end of the upfolded trailing bottom end flap, which may now be drooping from carton load thereon, will be guided up these successive upwardly sloped surfaces also for assuring the riding thereof over the adhesive applying head.

At the end of a cycle of processing a loaded carton through the machine to fold and anchor its top and bottom flaps the entrance gate is retracted to allow the entry of the next loaded carton upon the lifted Up/-Down carriage for travel toward the locality of the stop paddle. This is permitted by the fact that the pair of longitudinally elongated and transversely opposed clamping and guiding rails have been spread widely apart at the end of the preceding cycle of operation on the preceding carton for entry therebetween of this next oncoming carton. As these transversely opposed clamping and guiding side rails were spread widely apart at the end of the preceding cycle of action on the last carton processed therethrough a control manipulated at that time, e.g., a trigger tripped by the exiting carton, may cause manipulation of means to dictate relatively slow rise of the stop paddle into the path of this next oncoming carton. Preferably, this action of the stop paddle is effected by pneumatically driven motive means, as is the outward spreading and inward approaching of the clamping rails by a separate such pneumatic motive means. A plurality of solenoid valves in a pressurized gaseous medium system, such as three thereof (herein referred to for identification as SV1, SV3, and SV17), may be employed for this purpose.

Prior to the commencement of a cycle of operation of such equipment solenoid valve SV17 in de-energized condition supplies through a passage in its solenoid movable spool or core relatively highly pressurized air to and through a passage in the solenoid movable spool or core of solenoid valve SV3 for feed to one section of a dual piston pneumatic cylinder motor which applies retracting force to the piston means thereof. The exiting carton activated means causes energization of the solenoid valve SV3 so as to substitute another passage through its spool for the preceding one pneumatically to separate the side rails widely and to direct pressurized air to behind the main piston head of a pneumatic cylinder which lifts the stop paddle to its upright carton-stopping position. This raising action of the stop paddle preferably is at a relatively slow rate as is determined by adjustment of the rate of bleed off of pressurized air through escape valve means, and takes place partially as the side rails separating pneumatic motor or cylinder drives these rails apart by relatively high pressure. The final increment of slow raise of the stop paddle is effected just prior to arrival of the oncoming carton thereagainst and while the side rails are now moving inward toward opposite sides of the carton as it is stopped by the raised paddle for clamping the carton thereat at relatively high pressure, all as dictated by energization of solenoid valve SV1 as SV3 remains energized.

Following the completion of the uses of the closed gate function of the raised stop paddle and the cooperative carton clamping action of the side rails at the flap folding station beneath the elevating head the clamping action at relatively high pressure is reduced to a low pressure of only a few psi so as to convert the contacts of the carton sides by the rails to a guidance action which permits the chain conveyor to advance the carton therebetween. This condition is attained by de-energizing the solenoids SV1 and SV3 with maintenance of the de-energization of SV17 so that high pressure air is fed successively through the latter, an alternate passage in SV3 and other equipment to in front of the main piston head reversely to retract the latter for fast drop of the stop paddle to its lowest substantially flat position. Means are provided which dumps the retracting pressurized air in front of this main piston as the latter is fully retracted so that the stop paddle may rise rapidly to its intermediate position. This rapid dropping of the stop paddle and the dumping of the air from in front of this main piston occur at the time when the low pressure air is biasing the side rails lightly against the advancing carton sides as guides.

The use of this stop paddle to serve as a bottom end flaps guide ramp for assuring that they will ride up and over the adhesive applying head as the carton is advanced from the stop station beneath the top flaps folding head requires the somewhat rapid rise of this paddle to its intermediate oblique or forward sloping position. This rapid rise of the stop paddle is attained by maintaining the deenergization of SV1 and SV3 and now energizing SV17. The pneumatic cylinder motor has, in addition to its main head chamber in which its main piston head reciprocates, an auxiliary chamber in which a secondary piston head reciprocates with shorter stroke to effect the secondary upward swing of the stop paddle that is appreciably shorter than that of the full stroke which attains the upward swing to the upright stop-carton position. This secondary upward swing of the paddle is to its "intermediate position" which provides the upwardly and forwardly sloping ramp that guides the end flaps up over the adhesive applying head.

It is an object of the present invention to provide effective means for obtaining the above and related advantages in economical and reliable manners.

Another object of the invention is to provide simple and reliable means that will cause existing structures of the prior art economically to perform additionally desirable functions without requiring costly and complicated supplemental structures, such as means whereby the stop paddle not only performs its original intended stop-carton function, but will also convert to a forwardly and upwardly sloping effective ramp for guiding upfolded carton bottom end flaps upward over an adhesive applying head.

Other objects of the invention will in part be obvious and will in part appear from reference to the following detailed description taken in connection with the accompanying drawings, wherein like numerals identify similar parts throughout, and in which:

FIG. 1 is a perspective view, with parts broken away and in section, of a portion of the lowerable and liftable Up/Down carton conveying carriage which receives the loaded carton from the supply at the entrance end of the machine thereupon in its upper position for transport to a stop station beneath the top flaps folding head; this showing including a view of the stop paddle in its raised, carton-blocking position as mounted upon a cross beam of the carriage, the paddle manipulating device in the form of a pneumatic motor supported on a pivot carried by the machine fixed frame, and an adhesive-applying head also carried by this frame;

FIG. 2 is a side elevational view, with parts broken away and in section, of the structure shown in FIG. 1, depicting a portion of a loaded carton supported upon the top of such Up/Down carriage and abutted against the upright stop paddle;

FIG. 3 is a view similar to FIG. 2 with further parts omitted and broken away, but illustrating the retraction of the stop paddle to its prone, substantially lateral position for permitting the carton to be further advanced for travel to and beyond an adhesive-applying head;

FIG. 4 is a view similar to FIG. 3 indicating still further advance of the loaded carton as it is passing over the adhesive applying head, and with the stop paddle now raised from its retracted prone position of FIG. 3 back up to an intermediate position whereby it forms an oblique ramp for guiding drooping upfolded end flaps up to and over the adhesive-applying head;

FIG. 5 is a view similar to FIG. 4 showing the still further advance of the loaded carton beyond the adhesiveapplying head and with the stop paddle now being raised from its intermediate position of FIG. 4 to its upright position of FIG. 2 with the indication in broken lines of the next loaded carton as it abuts this raised stop paddle;

FIG. 6 is a transverse sectional view, with parts broken away, taken substantially on line 6—6 of FIG. 4.

Figure 1:
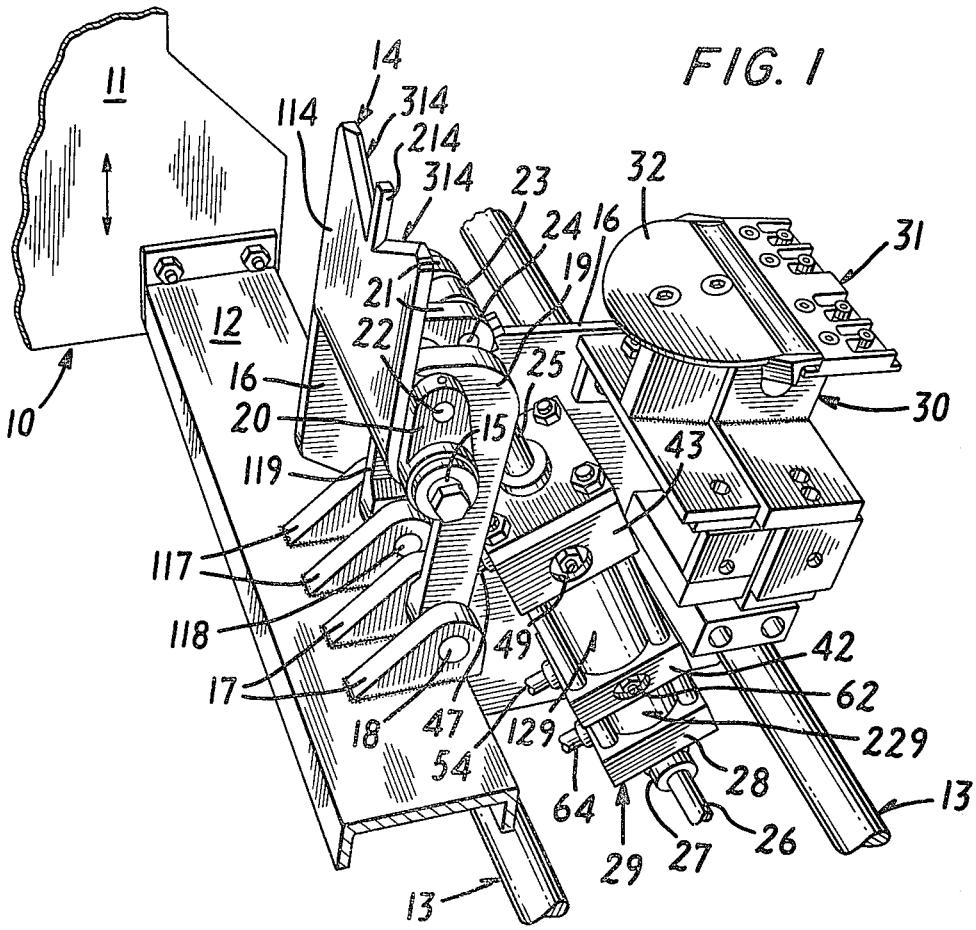

It is to be understood that many features of the automatic carton closing machine of the identified prior U.S. Pat. No. 3,496,697 are common to the machine in which the equipment of FIGS. 1 to 7 inclusive are embodied in accordance with the present invention. For example, the initial section of the loaded carton conveying equipment is embodied in a lifted lateral carriage 10, portions of a sidewall and cross beam of which are respectively seen at 11 and 12. The portions of cross rods 13 are representative of fixed machine base structure and bracing therein. The upright stop paddle 14 is pivotally mounted upon a transverse pin 15 that is supported at the far end upon a frame plate 16. The transverse carriage frame beam 12 is equipped with two pairs of upstanding ears 17 and 117, welded thereto, with each pair carrying respectively transverse wrist pins 18 and 118. Each of the wrist pins pivotally supports respectively the lower end of a gooseneck lever arm 19 and 119. The underside of the stop paddle blade 114 is equipped with two pairs of ears with one spaced pair 20 being located near the side edges thereof and the other spaced pair 21 being located therebetween. On each side wrist pin 22 pivotally mounts one of the outer ears 20 to the end of the gooseneck lever 19 and, intervening the pair of ears 21 is located a knuckle 23, which is pivotally carried therebetween by a cross pin 24. As will be better understood from FIGS. 2 and 4 the knuckle 23 is adjustably carried on the top end of a reciprocable stem 25 for raising and lowering the stop paddle 14.

The fixed frame of the machine carries a transverse shaft 26 on which is pivotally supported an ear 27 carried by base end 28 of a dual cylinder motor 29 which includes a piston rod 25 for lift and lowering reciprocation of the latter.

It will be seen from FIGS. 1 and 2 that forward, or beyond the stop paddle 14, the frame of the machine also carries in fixed position a pedestal 30 upon which is supported an adhesive-applying applicator head 31 over which the infolded bottom end flaps of the loaded carton must travel in order to have their lower surfaces applicator with the adhesive for adhering thereto the upfolded bottom side flaps. It will also be seen from these views that the approach edge of this transverse applicator head 31 is equipped with an oblique plow 32 for guiding such infolded end flaps up to and over the applicator head. The rearwardly and downwardly extending bottom edge 33 of this plow can cause trouble in advancing the loaded carton, one of which is shown at C in FIG. 2 with its chamber containing a load L (which, by way of example, may include three units $L_1$, $L_2$ and $L_3$) supported by infolded bottom leading and trailing end flaps 34 and 35 and the upfolded bottom side flaps 36 which are lapped up thereto for substantially covering the lower surfaces of these infolded bottom end flaps. This will require that the upfolded bottom side flaps 36 and 136 (FIG. 6) be dropped down obliquely for travel of the applicator head in a triangular space thereabove beneath the upfolded end flaps for applying the adhesive to the lower faces of the latter. This problem is emphasized in FIG. 3 wherein it is indicated that the load L may be of such a nature as to bear down upon the opposed free ends of the infolded bottom end flaps 34 and 35 to cause them to sag appreciably between the partially swung down bottom side flaps, so that the leading end 135 of the trailing upfolded bottom end flap 35 may be lower than the nose or lip 33 of the plow 32 to advance to beneath this lip and foul up the carton travel.

It will be understood from FIG. 4 that this problem can be avoided if there is some means for limiting the swing down of the infolded trailing bottom end flap so that its advancing nose 135 will be above the lip 33 of the oblique plow 32. As is therein indicated this limiting means advantageously and economically can be the pivoted stop paddle 14 which is preferably provided medially of its free end with an extension finger 214 to serve this purpose.

This demands that the stop paddle manipulating motive means be arranged to accomplish the needs demanded by such an additional duty of the stop paddle, and the present invention accomplishes this requirement in a quite simple and satisfactory manner. In processing in succession a series of such loaded cartons through the machine each will be released from the stop station for advance to the adhesiveapplying station first by the full retraction of the stop paddle 14, as in FIG. 3. Then, as a carton advances only partially past the adhesive applying head (FIG. 4) this stop paddle is raised to its intermediate oblique position there shown to make certain of proper guidance of the leading end 135 of the drooping trailing bottom end flap 35. The next oncoming carton will demand that with the passage of this carton beyond the adhesive applying head the stop paddle 14 be raised to its full carton blocking position of FIG. 1, and it is not necessary that time-wasting full retraction of such intermedially positioned stop paddle immediately therefollow before such full raising of the stop paddle again to its upright position. Since pneumatically driven equipment for so manipulating the stop paddle is preferred these successive operations will be best understood in connection with the somewhat diagrammatic showing in FIG. 7 of an axial section of such a pneumatic cylinder 29.

Figure 7:
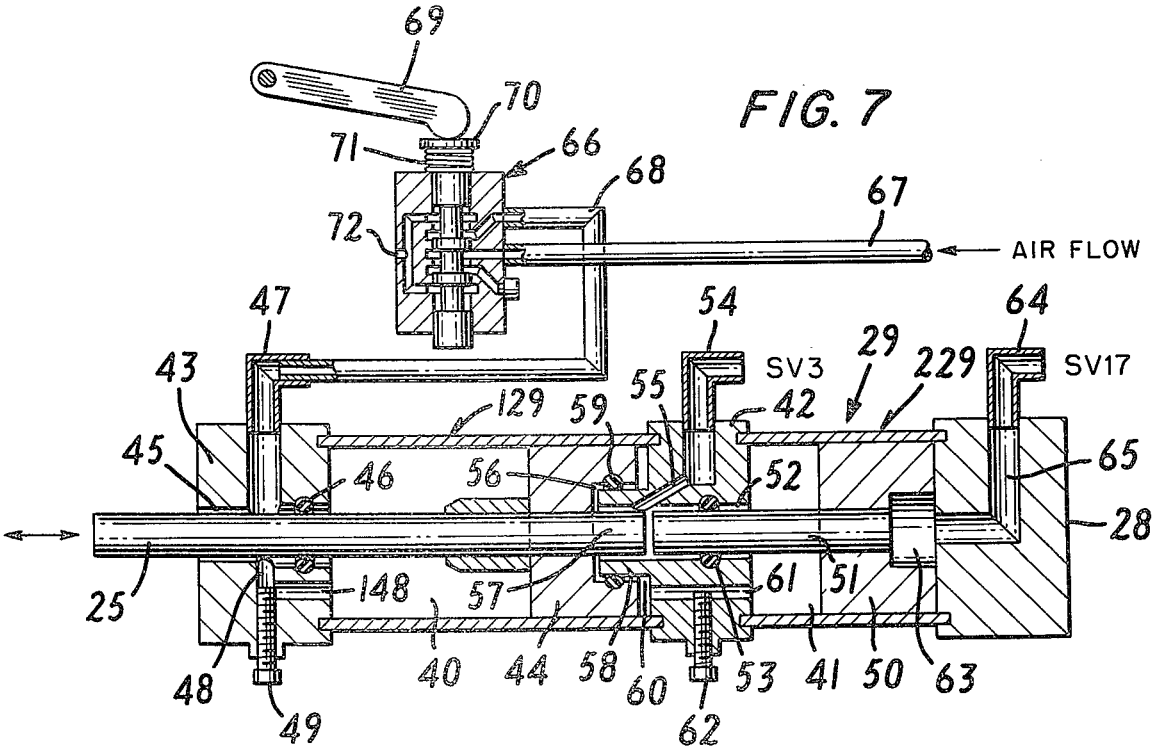
FIG. 7 is an enlarged detailed sectional view of the pneumatic motor, with parts broken away and in section, of pressurized air supply means associated therewith.

In FIG. 7 it is indicated that the barrel of the pneumatic cylinder 29 may be formed in two sections, i.e., a head end section 129 and a back end section 229. This structure is subdivided into two separate chambers consisting of a main head chamber 40 and a supplemental rear chamber 41, with the use of a medial partition 42 between which and a cross head 43 chamber 40 is defined. The opposite end is also closed by the rear cross head 28 so that the auxiliary chamber 41 is located between it and the medial partition 42. In the chamber 40 is reciprocatively mounted piston head 44 which carries the piston stem 25 that extends out through an axial passage 45 in the cross head 43 and is gasketed in this passage by an O-ring 46. Pressurized air may be supplied through an elbow fitting 47 leading to a medial opening 48 in the cross head 43 with this transverse passage having a branch 148 leading back to the chamber 40 past an adjustable needle valve 49 for controlling flow to this chamber, which is control of the cushion in this chamber.

Within the auxiliary chamber 41 is mounted a secondary or auxiliary piston head 50 which carries a relatively short, secondary piston rod 51 extending through an axial passage 52 in the partition 42, and it is gasketed to the walls thereof by an O-ring 53. Another pressurized air supply elbow 54, which may be considered a middle one, has its passage transversely connected to an oblique duct 55 which leads to the end of the piston head assembly 44 in chamber 40. The latter piston head has a cup-shaped recess 56 in its end surrounding a stub end 57 of the piston rod 25 which extends through this head into this cup, for close location to and substantial axial alignment with the leading end of the secondary piston rod 51. A sleeve extension 58 of the partition 42 surrounds this piston rod stub end 57 and the annular wall of the cup 56 is gasketed by another 0-ring 59 to this sleeve extension for forcing passage of pressurized air supplied through the elbow 54 and oblique passage 55 to travel through a channel 60 connected by a branch channel 61 through which flow is controlled by another adjustable pin valve 62, which is another cushion control. This dual chamber cylinder motor 29 actually is provided with a third chamber 63 in the form of a cup in the back end of the auxiliary piston head 50, to which a passage from a third pressurized air supply elbow 64 communicates by an internal passage 65 within the rear cross head 28.

The pressurized air supply elbow 47 preferably is caused to serve double duty by connecting it to the solenoid valve SV3 through a dumping valve 66. The dumping valve 66 has an inlet passage connected by a tube 67 to this solenoid valve SV3 supply passage whereby a passage through the dumping valve will be directly connected to the elbow 47 by an additional tube 68 for supply of relatively highly pressurized air from the common source thereof successively through the solenoid valve SV17, the solenoid valve SV3 and this dumping valve. However, as has been previously indicated, at full retraction of the piston valve stem 25 which is pivotally connected to the stop paddle 14, a condition which is illustrated in FIG. 7, this stop paddle is swung down to its full prone position (as shown in FIG. 3) and has associated therewith means physically to manipulate the dumping valve, such as by swinging the control arm 69 down to depress the slide core 70 against its upward biasing by spring 71, to the lower position shown. As a result, pressurized air in chamber 40, in front of piston 44, is dumped by way of an exhaust passage consisting successively of by-pass 148, port 48, outlet tube 68, clearance about and along the dumping valve internal section of slide core 70, and exhaust port or vent 72.

By way of example, let it be assumed that in an automatic carton closing machine an operative pressurized system for manipulating the side clamping and guide rails and the three-position stop and guide paddle is provided with a regulator controlled pressurized source of air which may be at about 60 psi. A conduit feeds this pressurized air to a through passage in the core of de-energized solenoid valve SV17 for feed successively through a passage in the core of energized solenoid valve SV3 and a pressure regulator set, for example, at 45 psi to the end chamber of the double-ended pneumatic cylinder which thrusts its piston in the direction to separate the side clamping and guide rails (indicated at 75 and 175 in FIG. 6) for reception of the oncoming loaded carton therebetween. For other purposes air at the relatively high pressure may be fed through another pressure reducing regulator to supply air at relatively low pressure, e.g., about 5 psi to the opposite side of the piston of this rail driving pneumatic motor so that the difference of such opposing pressures, i.e., 40 psi, effects the carton clamping action. This carton clamping action is effected by merely reversing the paths of supply flow of pressurized air at relatively high pressure and that at relatively low pressure to the opposite sides of the double-ended pneumatic motor piston, which is now attained by energizing the solenoid valve SV1. When it is desired to free the carton for further advance by dropping the stop paddle 14 out of its path while providing guidance by these rails it is this low pressure which biases them to the opposite sides of the carton while allowing free forward glide therebetween.

The raising of the stop paddle was effected by the energization of solenoid valve SV3 to supply the pressurized air through passage elbow 54 and duct 55 behind piston head 44 with feed of such pressurized air, past bleed control valve 62, into chamber 41 (which may be considered for purposes of tabulation as chamber B). Since the dumping valve 66 is manipulated to vent only upon complete depression of its slide core that is mechanically effected upon full retraction of the stop paddle 14 the lifting thereof by the pressurized air being fed to chamber 41 (B) is resisted by residual air in chamber 40 (which may be considered to by chamber A) to effect the desired slow raising of the stop paddle 14.

When the loaded carton is now ready for release for travel forward to have its bottom side flaps dropped down obliquely for ride upon the side rail oblique rollers 76 and 176 (FIG. 6) and so that adhesive applicator head 31 may apply adhesive to bottom surfaces of upfolded end flaps 34 and 35, the stop paddle 14 is dropped rapidly to its prone position with ultimate venting of chamber 40 (A) through the dumping valve 66. This rapid stop paddle drop is effected by the closing off of supply of pressurized air to chamber 41 (B) and supply of pressurized air through conduit 67, closed dumping valve 66, tube 68, elbow 47 and ducts 48 and 148. The then desired raise rapidly of the stop paddle to its intermediate position, i.e., the upfolded bottom end flaps guidance position, is effected by energizing the solenoid valve SV17 while the de-energization of the solenoid valves SV1 and SV3 is maintained, pressurized air being fed through a core passage in SV17 and an external flow control in a supply line leading to elbow 64 and through duct 65 into chamber 63 (chamber C) behind piston head 50. The travel of this head in chamber 41 is relatively short so that its stem 51 will apply only that limited thrust to piston stem 25 as is necessary to raise the stop paddle to its oblique, end flap-guiding position (FIG. 4).

The relative manipulations and conditions are indicated in the following tabulation through a cycle of operation:

| SOLENOID VALVES | | | DUMPING VALVE | STOP PADDLE | | | | SIDE RAILS | |
|---|---|---|---|---|---|---|---|---|---|
| | | | | POSITION | CHAMBER | | | POSITION | NOMINAL PRESSURE |
| SV1 | SV3 | SV17 | | | A | B | C | | |
| O | X | O | Q | UP | − | + | − | OUT | 40 psi |
| X | X | O | Q | UP | − | + | − | IN | 40 psi |
| O | O | O | D* | DOWN | + | − | − | IN | 5 psi |
| O | O | X | Q | INTERMEDIATE | − | − | + | IN | 5 psi |

X Energized
O De-energized
Q Closed
D Dump
+ Pressurized
− Depressurized
*Dumping Valve Dumps Pressure in Chamber "A" at End of Down Stroke.

It will be noted from FIGS. 1 and 4 that the free end of the stop paddle 14 has been provided with a pair of V-shaped notches 314, 314 flanking opposite sides of a retained central portion or finger 214 so that as the latter serves as the oblique end flap-guiding ramp these notches permit the infolded side flaps 36 and 136 to drop down to the oblique positions of FIG. 6. This is necessary to permit entry thereabove of the adhesive-applying head 31, and also between their laterally-spaced edges of the applicator head support and its supply duct embodying post 30. It will be seen in FIG. 4 that, although the leading end of drooping, infolded, bottom side flap 136 is depending or drooping appreciably, the following or trailing section thereof is held upward considerably higher by glide of its free edge through the far side stop paddle notch 314. This is true with respect to the companion drooping, infolded, bottom side flap on the near side, that has been broken away in this showing, and as to its glide through the near side stop paddle notch 314 there shown. Such limitation of the space between these oblique side bottom flaps helpfully provides some support for the load-warped upfolded bottom end flap 35.

It is indicated in FIGS. 4 and 5 that beyond the applicator head 31 and its support 30 the machine frame fixedly supports an upwardly curved scoop or plow 77, preferably having a mid rib or vertical fin 78. As the carton advances past the applicator head the leading ends of the drooping bottom infolded side flaps 36 and 136 engage the upwardly curved surfaces of this scoop to be gradually raised for ultimate horizontal lapping against the adhesive-carrying bottom faces of the upfolded bottom end flaps 34 and 35.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is the novel subjects matter defined in the following claims:

1. In an automatic carton closing machine constructed to provide adhesive anchorage of unfolded bottom side flaps to infolded bottom end flaps thereabove of each of successive cartons by partially swinging down the upfolded bottom side flaps to dropped oblique positions for entry into the space above the latter and below the infolded bottom end flaps of an adhesive applicator head located below the carton travel path in a forward section of the machine as the carton is advancing for application of adhesive to areas of the bottom faces of these infolded end flaps for subsequent lap by again folding these bottom side flaps up against them; the combination comprising 1. a stop paddle pivotally mounted on a transverse axis below said forward carton travel path for swing upward and rearward to a substantially upright position from a lower position for serving as a stop gate to be abutted by each oncoming carton so that each such carton is held therebehind until released by said gate as it is retracted, and swing forward and down to a prone lateral position from its upright position and passing down through an intermediate position in which it is oriented obliquely upward and forward for disposition of its top surface as an upwardly sloping ramp for guidance successively of the free trailing end of the front bottom end flap and then the free leading end of the back bottom end flap to the top of the applicator head for ride over the latter; and
2. means effecting and controlling swing of said stop paddle successively through a cycle of such swinging action during the period from a carton-receptive condition of the machine and the entry of a loaded carton through to abutment of this stop gate and then travel over the adhesive applicator head for subsequent completion of the folding of the carton closing flaps and anchorage thereof, comprising a first swinging action step of raising it from its lower position before arrival of such carton at the vicinity of said gate, a second action step of lowering it to release the carton for further advance of the latter, and a third action step of again raising it just to the intermediate ramp-forming position.

2. The carton closing machine stop paddle manipulating mechanism as defined in claim 1 characterized by means for effecting the first upright raising action step at relatively slow speed, the second retracting action step at relatively high speed and the third partial raising action step just to the ramp-forming position also at a relatively high speed.

3. The carton closing machine stop paddle manipulating mechanism as defined in claim 2 characterized by means providing and employing pressurized fluid at different pressures to perform said differing action steps.

4. The carton closing machine stop paddle manipulating mechanism as defined in claim 3 characterized by the pressurized fluid performing means being pneumatic motor means.

5. The carton closing machine stop paddle manipulating mechanism as defined in claim 1 characterized by means for pivotally supporting and manipulating said stop paddle including lifting and lowering lateral carriage means and means to lift it to and temporarily maintain it at an upper elevation for receiving thereon from the entry end of the machine a loaded carton having the bottom flaps of the latter upfolded and to advance this carton into the machine to abutment of said raised stop paddle, said adhesive applicator head being supported forward thereof in a relatively fixed position by the frame of the machine.

6. The carton closing machine stop paddle manipulating mechanism of claim 5 characterized by pressurized fluid operating means for effecting the successive action steps of the cycle of operation of said stop paddle, said operating means being in the form of fluid motor means including a cylinder and piston means reciprocable therein, means pivotally connecting said piston means to said stop paddle and means pivotally connecting said cylinder to the machine frame.

7. The carton closing machine stop paddle manipulating mechanism of claim 6 characterized by said fluid motor means and its reciprocative cylinder and piston means comprising a pair of cylinder chambers with piston means in one adapted to have a relatively long thrust and retraction travel stroke sufficient to swing said stop paddle up from its prone position to its upright position and return, and piston means in the other capable of a relatively shorter stroke for swinging said stop paddle up to only an intermediate position.

8. The carton closing machine stop paddle manipulating mechanism of claim 7 characterized by said fluid motor means defining an in-line dual piston and chamber assembly wherein said relatively long travel stroke piston means includes a main piston stem constituting the means that is pivotally connected to said stop paddle, said shorter stroke piston means including a secondary piston stem aligned behind said main piston stem for applying to the latter a shorter stroke thrust to effect swing up of said stop paddle to its intermediate sloping ramp position.

9. The carton closing machine stop paddle manipulating mechanism of claim 8 characterized by inlet flow passages leading to the piston chambers having flow checking obstructions to govern rate of flow therethrough for producing cushioning action of said piston means.

10. The carton closing machine stop paddle manipulating mechanism as defined in claim 1 characterized by a three-position, pressurized fluid operated cylinder motive means controlling and effecting such swinging actions of said stop paddle.

* * * * *

UNITED STATES PATENT AND TRADEMARK OFFICE

CERTIFICATE OF CORRECTION

PATENT NO. : 4,006,579

DATED : February 8, 1977

INVENTOR(S) : Winton Loveland

It is certified that error appears in the above-identified patent and that said Letters Patent are hereby corrected as shown below:

Patent "ABSTRACT" line 8, "dropping" should read --drooping--; column 4, line 12, "hesiveapplying" should read --hesive-applying--; column 5, line 41, "adhesiveapplying" should read --adhesive-applying--; column 7, line 54, "by" should read --be--; column 9, line 16 (claim 1) "unfolded" should read --upfolded--.

Signed and Sealed this

Tenth Day of May 1977

[SEAL]

*Attest:*

RUTH C. MASON
*Attesting Officer*

C. MARSHALL DANN
*Commissioner of Patents and Trademarks*